US012637121B2

(12) United States Patent
Kremer

(10) Patent No.: US 12,637,121 B2
(45) Date of Patent: May 26, 2026

(54) SYSTEM AND METHOD FOR MONITORING THE STATE OF A WHEEL OF A RAIL VEHICLE

(71) Applicant: KNORR-BREMSE Systeme für Schienenfahrzeuge GmbH, Munich (DE)

(72) Inventor: Miklos Kremer, Budapest (HU)

(73) Assignee: KNORR-BREMSE Systeme für Schienenfahrzeuge GmbH (DE)

( * ) Notice: Subject to any disclaimer, the term of this patent is extended or adjusted under 35 U.S.C. 154(b) by 432 days.

(21) Appl. No.: 18/034,299

(22) PCT Filed: Oct. 4, 2021

(86) PCT No.: PCT/EP2021/077261
§ 371 (c)(1),
(2) Date: Apr. 27, 2023

(87) PCT Pub. No.: WO2022/089880
PCT Pub. Date: May 5, 2022

(65) Prior Publication Data

US 2023/0406374 A1 Dec. 21, 2023

(30) Foreign Application Priority Data

Oct. 27, 2020 (DE) ..... 10 2020 128 188.9

(51) Int. Cl.
*B61K 9/12* (2006.01)
*B61L 15/00* (2006.01)

(52) U.S. Cl.
CPC ..... *B61K 9/12* (2013.01); *B61L 15/0081* (2013.01)

(58) Field of Classification Search
CPC ... B61K 9/00; B61K 9/02; B61K 9/04; B61K 9/12; B61L 15/00; B61L 15/0058; B61L 15/0062; B61L 15/0081
See application file for complete search history.

(56) References Cited

U.S. PATENT DOCUMENTS

2019/0339167 A1 11/2019 Davidich et al.
2020/0079343 A1* 3/2020 Martin ..... B61H 15/00

FOREIGN PATENT DOCUMENTS

CN 110217266 A 9/2019
CN 110626382 A 12/2019
(Continued)

OTHER PUBLICATIONS

Zwierczyk, Peter Tamas: Thermal and stress analysis of a railway wheel-rail rolling-sliding contact. 2015. pp. 1-91, coverpage, catalogue ID: 000579438).
(Continued)

*Primary Examiner* — Robert J McCarry, Jr.
(74) *Attorney, Agent, or Firm* — Barnes & Thornburg LLP

(57) ABSTRACT

A system for monitoring the state of a wheel of a rail vehicle includes an acquisition unit that is designed, upon a braking event, to acquire at least one operating parameter for the wheel, an evaluation unit that is designed to determine a temperature value for the wheel based on the acquired operating parameter; and a control unit that is designed to generate and to output an output on the basis of the determined temperature value. It furthermore relates to a method for monitoring the state of a wheel of a rail vehicle, in which, upon a braking event, at least one operating parameter for the wheel is acquired, a temperature value for the wheel is determined based on the acquired operating parameter and
(Continued)

an output is generated and output on the basis of the determined temperature value.

22 Claims, 4 Drawing Sheets

(56) References Cited

FOREIGN PATENT DOCUMENTS

| | | | |
|---|---|---|---|
| CN | 111791916 | A | 10/2020 |
| EP | 0818372 | B1 | 10/2002 |
| EP | 2231448 | B1 | 6/2014 |
| JP | 2020056747 | A | 4/2020 |
| WO | 2013186137 | A1 | 12/2013 |

OTHER PUBLICATIONS

International Search Report and Written Opinion corresponding to PCT/EP2021/077261 dated Jan. 17, 2022.

* cited by examiner

Temperature distribution vs time on the wheel side at the intersection of the sample lines St and S during five full revolutions (assumed heat distribution: 0.5)

SYSTEM AND METHOD FOR MONITORING THE STATE OF A WHEEL OF A RAIL VEHICLE

CROSS REFERENCE AND PRIORITY CLAIM

This patent application is a U.S. National Phase of International Patent Application No. PCT/EP2021/077261 filed Oct. 4, 2021, which claims priority to German Patent Application No. 10 2020 128 188.9, the disclosure of which being incorporated herein by reference in their entireties.

FIELD

Disclosed embodiments relate to a system and a method for monitoring the state of a wheel of a rail vehicle, in particular during the operation of the rail vehicle.

SUMMARY

Disclosed embodiments advantageously develop a system and a method of the type set forth at the outset, in particular to the effect of being able to recognize the formation of critical structures in the material of a wheel and/or an initiation of cracks.

Disclosed embodiments provide a system for monitoring the state of a wheel of a rail vehicle.

Disclosed embodiments provide a system for monitoring the state of a wheel of a rail vehicle to comprise a recording unit configured to record at least one operating parameter for the wheel in the event of a braking event; an evaluation unit configured to determine a temperature value for the wheel on the basis of the recorded operating parameter; and a control unit which is configured to generate and output an output on the basis of the determined temperature value.

BRIEF DESCRIPTION OF FIGURES

The method is designed in particular to operate the system. It therefore has the same advantages as the system.

DETAILED DESCRIPTION

Figure 1A:
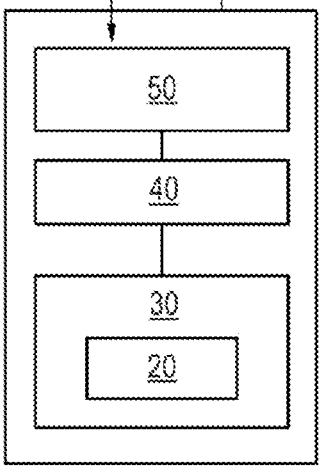
FIG. 1A shows an exemplary embodiment of the system.

The wheels of a rail vehicle are subjected to heavy loads during braking procedures. Damage to the wheels, for instance due to strong friction or sudden and massive heating of the material, should be avoided in the process. This is difficult, in particular, if the brakes are applied very hard in the case of unfavorable adhesion properties of the underlying surface. For example, this may occur more frequently in regions that are exposed to a maritime climate, especially when there is high humidity and, accompanying this, poor adhesion between wheel and rail.

Systems which prevent a wheel from locking or slipping during the braking process are known. For example, this avoids the formation of flat spots in the otherwise circular circumference of the wheel. However, under adverse conditions, cases may occur in which there is damage to the wheel or there are disadvantageous changes in the material, for example connected with the formation of martensite in the material of the wheel. Regions of a metal wheel, especially in the region of the wheel tread, where the structure of the material has changed to martensite, are harder and more brittle than the surrounding material and are therefore often the starting point for the formation of surface cracks and material loss.

The practice of examining unpowered wheels at specific intervals using a non-destructive test and, if necessary, removing damaged material, for instance using a lathe, is known.

For example, a method for detecting a crack in a wheelset of a rail vehicle is known from EP 3 517 927 A1.

Further, DE 198 33 027 C1 describes a method for testing a railway wheel.

Further, an apparatus for electromagnetic and ultrasonic wheel diagnostics is known from EP 1 485 704 A1.

Moreover, EP 3 206 933 A1 describes a method for diagnosing the state of wheels of a rail vehicle.

Disclosed embodiments are based on the basic concept of being able to recognize a microstructural change in the wheel, still during ongoing operation, by temperature monitoring or thermal monitoring. In principle, the microstructure diagrams are known and can be stored in the system. If the thermal monitoring, optionally also the temperature profile over time (i.e., monitoring of the temperature curve), and the corresponding comparison or if monitoring the temperature curve alone without comparison indicates that a problematic microstructural transformation is taking place or may take place, or if there is a risk of this happening, then a corresponding warning message is output.

This advantageously provides relevant parameters for the state and the safety of a wheel and for its maintenance. Furthermore, maintenance costs can be optimized by using particularly complex methods in a particularly targeted manner. Furthermore, maintenance work can advantageously be planned and carried out according to necessity rather than fixed time intervals; this avoids unnecessary maintenance work. Further, the wheel can be treated on the lathe even before cracks can form and spread in the material.

The state of the wheel can be monitored during the ongoing operation of the rail vehicle in particular. This is an important difference from known methods, in which the monitoring takes place at predetermined time intervals, for example, and the rail vehicle has to be taken to a workshop, for example. In accordance with the disclosed embodiments, the data recorded during the braking event are evaluated directly and conclusions about the state of the wheel can be output directly.

Thus, in accordance with disclosed embodiments, monitoring or diagnostics can be performed in order to recognize the formation of martensite and/or other indications of crack or fracture formation. Further, a risk of weakening of the material can be recognized. Moreover, the diagnosis can be used to detect the occurrence of hazards after braking in the case of a disadvantageous adhesion profile.

A basic concept of the disclosed embodiments consists of a probability of the formation of martensite in the wheel of the rail vehicle being determined. This information is then used to identify whether the wheel needs to be checked, for instance using a non-destructive testing method, and/or whether the wheel needs to be treated, for example using a lathe.

This exploits the fact that modern rail vehicles often record a multiplicity of parameters that can be used to determine the energies occurring at the contact between wheel and rail. In particular, the system makes use of the fact that the speeds of the wheels and the speed of the rail vehicle, that is to say a reference speed, can be recorded. These values are already used, for instance to recognize or prevent wheel slippage. By way of example, a "wheel slide protection" (WSP) system or a similar system is used. Moreover, values recorded by a brake control unit (BCU) can be used, which values record the brake pressures applied by the brake cylinders, for example.

The speeds of the wheels and of the vehicle and the cylinder pressures of the braking system can be used in a simplified thermal model of the material of the tread of a wheel, in particular in order to determine a temperature distribution in the material. Such a model can be implemented by the evaluation unit.

In order to simulate the rise and/or fall of the temperature in the material as realistically as possible, for example in order to calculate the temperature peaks at a position of the wheel per revolution of the wheel, a more detailed thermal model of the material of the tread of a wheel, in particular, is necessary, for example for carrying out a simulation using a finite element method. Calculations based on such a model may require significant computing power and the calculations may take a long time. This usually precludes the use of such a detailed model in an evaluation unit provided directly in the vehicle. Instead, provision can be made for a table which contains temperature values and/or a characteristic curve and which the system then accesses to be determined away from the rail vehicle on the basis of the more detailed thermal model; for example, a table and/or a characteristic curve can be stored in a memory unit of the system.

In the system, an average temperature of the wheel therefore can be calculated using the simplified thermal model and the locally occurring peak values can be determined by lookup in a table, with the values stored in the table having been determined with greater computational effort and using more complex models. In particular, the peak values determined on the basis of the table are added to the average temperature. The time-temperature curves obtained in this way can be compared with material-specific curves that describe the conditions for certain changes in the metal microstructure.

A plurality of conditions relating to the formation of certain critical points or material changes can be checked, in particular conditions that incrementally build on one another.

By way of example, it is possible to initially determine whether the conditions are sufficient for the formation of austenite, for instance a specific temperature increase for a specific time. Further, it is possible to determine whether cooling has subsequently taken place sufficiently quickly for the formation of martensite.

In particular, a probability of martensite having formed is determined. In particular, the probability can be determined for a specific wheel, a pair of wheels or a differently defined wheelset.

By way of example, an error code that comprises a particular probability of martensite formation in a wheel may be generated, output, and/or stored.

In one embodiment of the system, the recording unit is also configured to record a braking parameter, in particular a brake pressure of a brake cylinder and/or a braking force.

As a result, the energy that has to be dissipated during braking via the contact between the wheel and the rail can advantageously be determined in a particularly simple and direct manner. Further, this operating parameter is usually particularly easily accessible via a brake control unit of the rail vehicle.

In a further embodiment, the operating parameter recorded for the wheel comprises a wheel speed, in particular a rotational speed of the wheel, and/or a speed of the rail vehicle.

As a result, the kinetic energy to be absorbed during braking can advantageously be determined easily using basic parameters of the operation of the rail vehicle. It is also possible to check whether the wheel locks when braking or continues to turn. In particular, the aforementioned values are easily recordable by a control device which is usually already present and by which, for example, the wheel is prevented from slipping during braking.

In a development, the operating parameter recorded for the wheel comprises a time derivative of the wheel speed, in particular of the rotational speed of the wheel, and/or of the speed of the rail vehicle. In particular, a first-order and/or higher-order time derivative of the wheel speed, in particular of the rotational speed of the wheel, and/or of the speed of the rail vehicle can be recorded.

As a result, the dynamics of the braking event are advantageously recorded particularly easily, and the arising energies can be easily determined.

In an embodiment, the at least one operating parameter for the wheel is able to be recorded by an anti-slip system. By way of example, the recording unit is comprised by the anti-slip system, or the anti-slip system can be used as a recording unit.

As a result, the possibilities of an anti-slip system, which is known per se, is possibly already present, and can be integrated for instance into a brake control unit of the rail vehicle, are advantageously used for recording the operating parameter. The system can be operated particularly efficiently in this way. Further, it can be integrated particularly easily into existing rail vehicles, since at best no new sensor devices need to be provided.

That is to say, the rail vehicle has an anti-slip system ("wheel slide protection system", WSP), by which the operating parameter for the wheel is recorded. Furthermore, provision can be made for at least one of the plurality of operating parameters recorded for the wheel to be recorded by the anti-slip system.

WSP systems are usually already designed in such a way that a wheel speed, a vehicle speed, and/or a brake pressure are recorded. It is therefore particularly easy to access these already existing data.

In a further embodiment, the temperature value determined for the wheel comprises an average temperature of a tread of the wheel and/or a temperature distribution along the tread of the wheel and/or a temperature on a contact surface of the wheel. In particular, whether the wheel continues to turn when braking or whether it locks and slides on the rail is determined in the process.

As a result, it is advantageously possible to determine directly whether specific temperature-related damage to the wheel should be assumed. In particular, phase transitions or microstructural changes which, for example, promote the development of expanding damage regions, such as cracks, may occur when the material is heated and/or cooled.

In a development, when determining the temperature value for the wheel, the evaluation unit is configured to determine the average temperature of the tread of the wheel using a simplified thermal model and to determine peak temperatures using a lookup table.

In this way, an analysis method that is able to be carried out with a manageable amount of computing effort is advantageously combined with more complex simulation methods.

The simplified thermal model makes it possible to determine the average temperature of the tread with sufficient accuracy practically in real time on the basis of the recorded operating parameter. The analysis can be carried out, for example, by a computing unit in the rail vehicle itself.

The determination of the temperature peaks which may occur during a braking process is usually carried out using very computationally intensive methods and therefore typically cannot be carried out in real time, at least not with the usual on-board resources of a rail vehicle. Therefore, simulations can be used to determine values under different conditions and these values can be stored in a lookup table. The evaluation unit is then configured to determine and apply the value or values from the lookup table that match the currently recorded operating parameters. In this case, the lookup replaces the completely new calculation and allows the results to be sufficiently accurate.

In particular, the temperature on a contact surface of the wheel with the rail can also be determined using the simplified thermal model.

In an embodiment, the control unit is configured to generate the output depending on at least one temperature threshold value being reached. The output can also be generated on the basis of a change in the recorded operating parameter over time. Optionally, the control unit is also configured to determine a probability of occurrence of a damaged region, in particular a probability of martensite formation, and to generate the output on the basis of at least one probability threshold value.

This advantageously indicates possible problems with the wheel.

For example, the probability with which specific conditions, which are defined on the basis of the recorded operating parameter, can lead to specific damage can be analyzed. The output can then comprise information regarding the expected probabilities of different problems, and countermeasures can be taken in a targeted manner, for example specific maintenance measures.

In a further embodiment, the output comprises a warning message and/or a diagnostic message and/or an error code. In this case, the control unit is optionally configured to store the output in a diagnostic memory.

As a result, the output can advantageously be read out at a later stage, for example by an authorized user.

The output is also able to be output directly. By way of example, an optically or acoustically perceptible signal can be generated depending on the output. By way of example, a first signal may be output if the output comprises a specific error code and a second signal may be output if the output comprises a further error code.

The signal can be used, for example, to output a request to carry out a specific maintenance measure.

At least one operating parameter for the wheel is recorded during a braking event in the method for monitoring the state of a wheel of a rail vehicle. A temperature value for the wheel is determined on the basis of the recorded operating parameter, and an output is generated and output on the basis of the determined temperature value.

FIG. 1A shows an exemplary embodiment of a system 100 according to the disclosed embodiments.

In the exemplary embodiment shown, the system 100 is integrated into a rail vehicle 10 or is a subsystem of a rail vehicle 10.

The rail vehicle 10 thus comprises the system 100.

The system comprises a recording unit 20.

The recording unit 20 is a constituent part of an anti-slip apparatus 30, which is formed in the manner of a WSP (wheel slide protection) system in a manner known per se.

The system 100 further comprises an evaluation unit 40.

The system 100 further comprises a control unit 50.

The recording unit 20 is configured to record at least one operating parameter for the wheel during a braking event.

The recording unit 20 can further be configured to record the presence of the braking event itself, for instance by virtue of recording an activity of a brake cylinder.

The evaluation unit 40 is configured to determine a temperature value for a wheel of the rail vehicle 10 on the basis of the recorded operating parameter.

The control unit 50 is configured to generate and output an output on the basis of the determined temperature value.

In principle, the function of the system 100 can be described as follows:

Data used by the evaluation unit 40 to monitor the temperature are recorded by the recording unit 20. In particular, a temperature or a development of the temperature over time, which occurs at a wheel during a braking event, is determined. This thermal monitoring is used to recognize during ongoing operation of the rail vehicle 10 whether the conditions for a specific microstructural change in the wheel are present. In particular, microstructure diagrams known per se are used to this end.

Should it be determined that the conditions for a problematic microstructural transformation are present, then an appropriate output can be generated.

The system 100 enables the following advantages:

Critical states of the wheel can be recognized during the ongoing operation of the rail vehicle 10, and operational safety can be improved.

Such critical states can be indicated, in particular in direct temporal connection with their occurrence and/or at a later point in time.

Furthermore, maintenance or repair measures can be initiated, for instance to remedy damage to the wheel which has occurred, or which is at risk of occurring, during the braking event.

In addition, maintenance or preventative measures can be initiated in order to prevent damage before it occurs.

Furthermore, maintenance work can be carried out as required in order to avoid unnecessary measures.

Figure 1B:
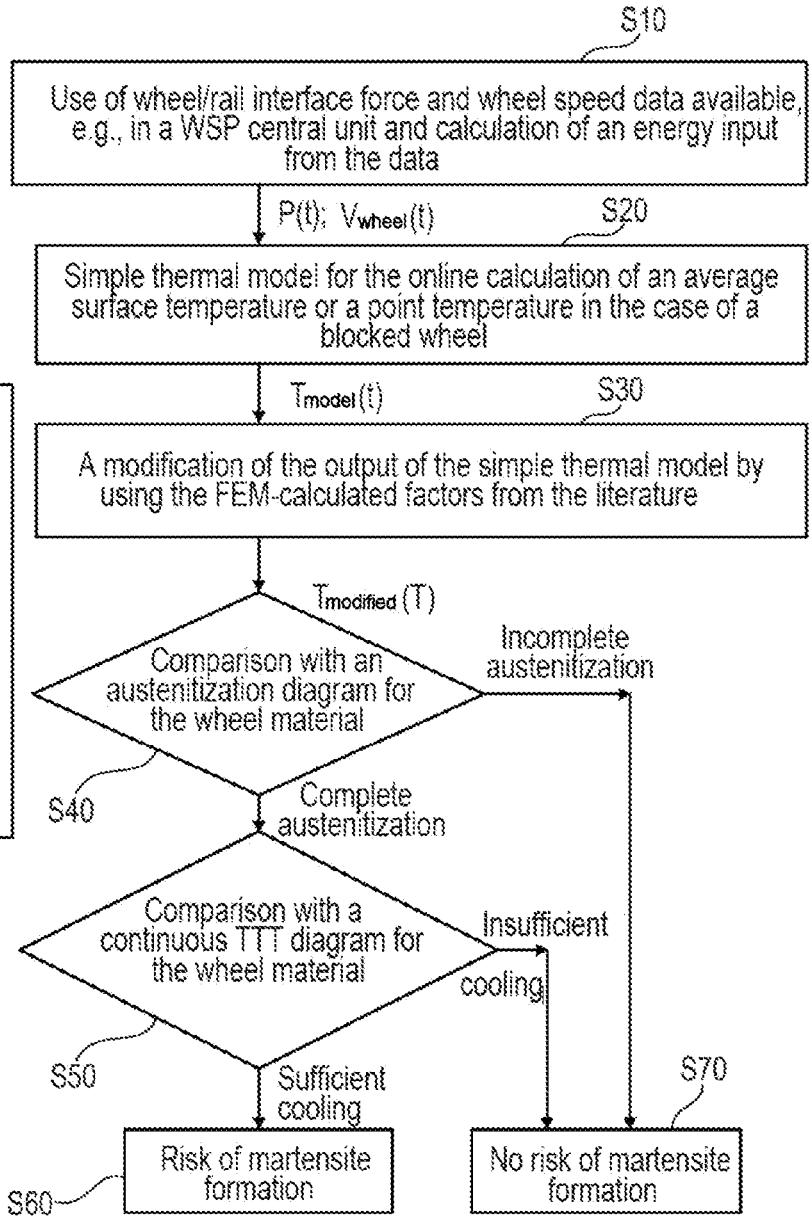
FIG. 1B shows an exemplary embodiment of the method.

FIG. 1B shows an exemplary embodiment of the method which is explained below. The starting point here is, in particular, the exemplary embodiment of the system explained above with reference to FIG. 1A, which is specified in more detail by the following explanations.

In particular, a diagnostic method that is able to be executed on a computer device is shown here.

In an operation S10, at least one operating parameter for the wheel is recorded during a braking event.

In the process, a force is determined at a contact surface between the wheel and the rail.

Data about the speed of the wheel is recorded.

Furthermore, a braking force of braking equipment of the rail vehicle is recorded.

In particular, the exemplary embodiment provides for a control unit of an anti-slip apparatus (WSP) to process the recorded operating parameters and data.

An energy absorbed by the wheel via the contact surface is determined.

The variables that occur in this context may include, for instance, a braking force P(t) and a wheel speed Vwheel(t), which each depend on the time t and in particular are recorded as a function of the time t.

A simplified thermal model of the wheel is used in an operation S20. A check is carried out as to whether the wheel rotates during braking or whether it locks and slides over the rail (wheel lock up). In particular, the values recorded or determined in operation S10 are used in the model.

An average temperature Tmodel(t) of the wheel tread is determined as a function of time t using the simplified mode if the wheel turns during braking.

The temperature Tmodel(t) for the contact region between the wheel tread and the rail is determined as a function of time t using the simplified model if the wheel is locked during braking.

The temperature Tmodel(t) determined using the simplified model is modified in an operation S30.

In the process, use is made of parameters determined in advance by simulation using an FEM method. For instance, these parameters are provided by a storage unit.

In the process, a modified Tmodified(t) is determined as a function of time t.

In an operation S40, the temperature Tmodified(t) determined thus is compared with a predetermined diagram which comprises a characteristic curve which characterizes the prerequisites for austenitization of the material of the wheel or its tread.

Figure 5:
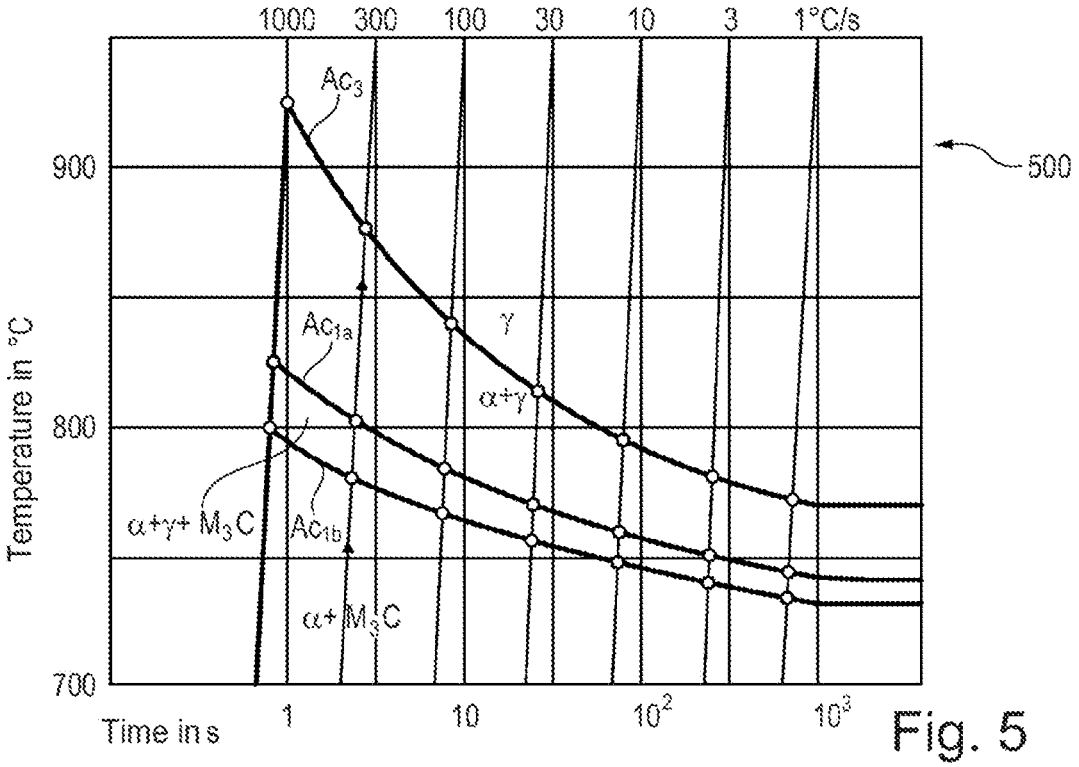
FIG. 5 shows characteristics relating to the formation of austenite.

An exemplary diagram 500 which can be used in operation S40 is shown in FIG. 5.

In particular, a check as to whether austenitization has taken place is carried out in the process. Should this not be the case, then it is determined in an operation S70 that there is no risk of martensite formation.

However, should the prerequisites for austenitization be determined as being present in operation S40, then the determined temperature Tmodified(t) is compared with a predetermined further diagram in an operation S50, the further diagram comprising a characteristic curve which characterizes the prerequisites for the formation of martensite for the material of the wheel or its tread.

Figure 6:
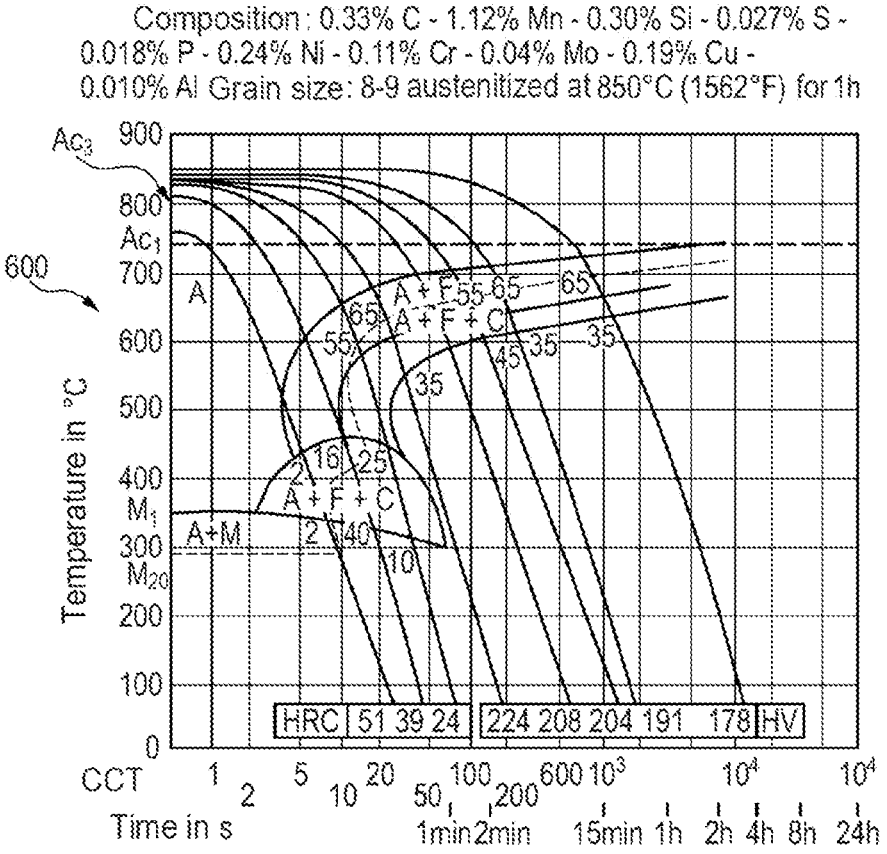
FIG. 6 shows characteristics relating to the formation of martensite.

An exemplary diagram 600 which can be used in operation S50 is shown in FIG. 6.

In particular, a check is carried out here as to whether the prerequisites for the formation of martensite are present, especially in the case of a sufficiently quick cooling of the material. Should this not be the case, then it is in turn determined in operation S70 that there is no risk of martensite formation.

However, should the prerequisites for the formation of martensite, for instance sufficiently rapid cooling, be determined as being present in operation S50, then a risk of martensite formation is determined in an operation S60.

In the method, an output is subsequently generated and output. By way of example, the latter comprises an error code which indicates whether or not there was a risk of martensite formation.

In a further exemplary embodiment of the method, a probability of martensite having formed is also determined in operation S60. The output generated may comprise this probability.

In a further exemplary embodiment of the method, a probability of martensite having formed can be alternatively or additionally determined in a manner analogous thereto in operation S70. The output generated may comprise this probability.

In particular, a threshold value may be specified and the determined value of the probability of martensite having formed can be compared with the threshold value. The output can then be generated on the basis of this comparison. For example, a warning message can be generated and output if the threshold value has been exceeded.

Integrated sensors, in particular, are provided in the case of an anti-slip apparatus 30, by which the wheel should be prevented from slipping on the rail.

For instance, the recording unit 20 may comprise sensors of the MGS3 type.

The values and parameters recorded by the recording unit 20 make it possible to determine the current heat on the wheel surface in real time or almost in real time. Even with current anti-slip equipment (WSP, "wheel slide protection"), it is not always possible to prevent the wheels from being overloaded, especially due to the input of energy or heat during a braking process. However, it is possible to detect that sliding occurs on the basis of the data recorded by the anti-slip equipment, and/or the duration of a sliding process of a wheel or a wheelset can be determined. A suitable thermal model of the wheel and known material properties of the wheel can be used to determine whether and how transitions between different material states occur, for instance between different microstructures or phases of a metal material.

Typically, relatively large regions of particularly hardened material are prone to cracks developing there or material flaking off, for example. To prevent this, provision can be made for example for a diagnostic memory to be read out at regular intervals, for example monthly or on specific occasions, for instance during regular maintenance of the wheel or wheelset. The data stored in the diagnostic memory can be used to determine whether the wheel should be treated using a lathe. Further, on the basis of the data stored in the diagnostic memory, it is possible to determine that no treatment using a lathe is required. Further, on the basis of the data stored in the diagnostic memory, it is possible to determine that a non-destructive diagnosis of the wheel or wheelset should be carried out, for instance by ultrasound, in order to detect cracks and/or local changes in the hardness of the material.

FIGS. 2 to 6 show further exemplary details of the system and the method, which are explained below.

A model by which the formation of a potentially hardened material texture can be determined is described below in exemplary fashion. In particular, martensite formation can be determined and/or a probability of martensite formation having occurred during a braking event is determined.

The wheel speed, the vehicle speed, and the brake pressure applied by a brake cylinder are recorded by the sensors comprised in the recording unit.

A simplified thermal model which is provided by the evaluation unit, for example, is accessed.

The simplified thermal model can be provided, for instance, on a plug-in card and/or a computing unit of a central control unit.

By way of example, the energy absorbed by the wheel is determined first, for instance according to the following model, which is explained with reference to FIG. 2A and FIG. 2B, and also FIG. 4:

To calculate the absorbed energy for a wheelset, for example with wheels i=1, 2, 3, 4 in the case of a four-wheel wheelset, the sliding speed is multiplied by the actual braking force at the contact between the wheel 210, 420 and the rail 440.

A contact force is determined on the basis of the pressure of the brake cylinders. Further, the angular acceleration of the wheelset is additionally taken into account, where J denotes a moment of inertia of the wheels:

$$P_i=(v_i-v_{ref})\cdot\{F_i(p_{ci})+J\cdot\dot{v}_i/R^2\}$$

Here, Fi denotes the braking force acting on an individual wheel 210, 420 at the contact surface between wheel 210, 420 and rail 440. This is a direct function of the actual brake pressure pc. This function F(pc) can be determined for instance using the general calculations of a braking process, for instance as described in UIC 544-1.

There are WSP systems that determine this force directly, with the actual acceleration of the wheelset being recorded so that the latter can be used directly.

The surface temperature can subsequently be determined, it being possible, in particular, to take into account that a permanent heat partition of approximately 50% may quickly arise in this case, that is to say approximately 50% of the heat generated is absorbed by the wheel. This is described, for example, in P. T. Zwierczyk, "Thermal stress analysis of a railway wheel-rail rolling-sliding contact", Budapest 2015. A different partition can be assumed for further models, for instance depending on certain environmental parameters.

A simplified thermal model of the wheel 210, 420 can be determined.

Two states, in particular, are distinguished in the simplified thermal model:

a) If the wheel 210, 420 is not turning, that is to say if it is locked, then the assumption is made that the energy is absorbed via the contact point or contact region 230 between the surface of the wheel and the rail. This case is shown in FIG. 2A in particular.

b) If the wheel 210, 420 is turning, then the assumption is made that the energy is absorbed uniformly across the tread 230 of the wheel 210, 420 at the contact points between the surface of the wheel 210, 420 and the rail 440. This case is shown in FIG. 2B in particular.

In a modification of the case explained under b), the further assumption is made that the heat is absorbed at a point on the contact surface between wheel 210, 420 and rail 440 and then released again during further rotation of the wheel 210, 420 until the point comes into contact with the rail 440 again.

Figure 3:
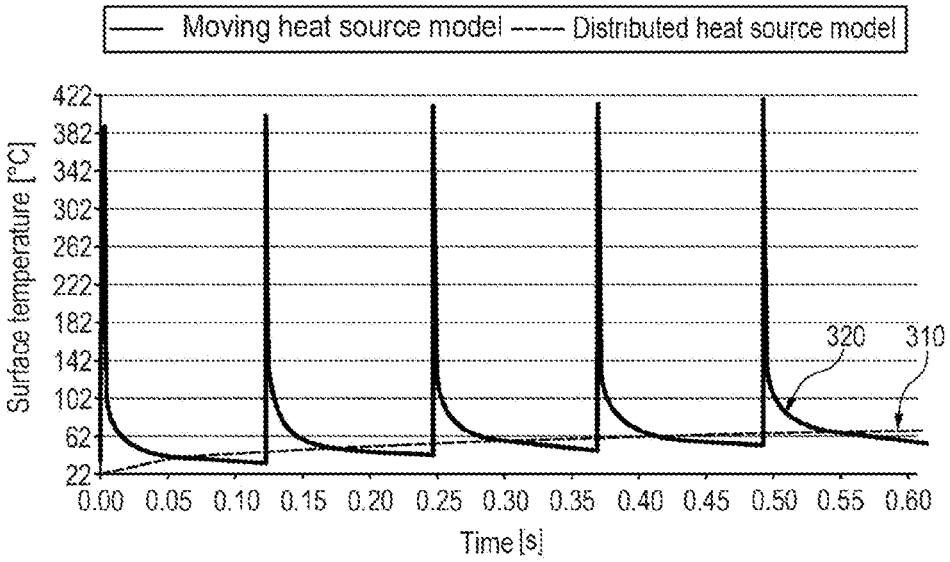
FIG. 3 shows a time-temperature diagram.

FIG. 3 shows an example of a temperature curve determined according to this modified model: At the peaks in temperature, the observed point on the tread of the wheel 210, 420 touches the rail 440 and absorbs heat, and then contact is broken and the point cools again. The average temperature of the wheel is shown as a dashed line; the temperature with additional peaks is shown as a solid line.

Figure 2A:
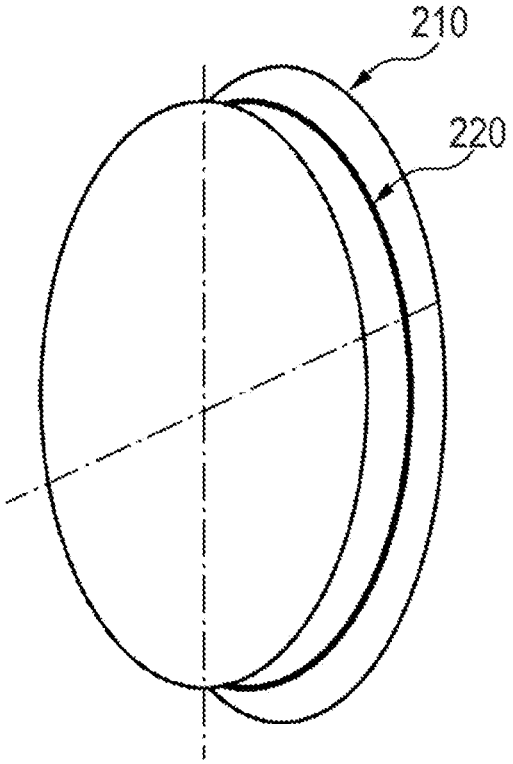
FIGS. 2A and 2B show schematic illustrations of a wheel under different braking conditions.
Figure 2B:
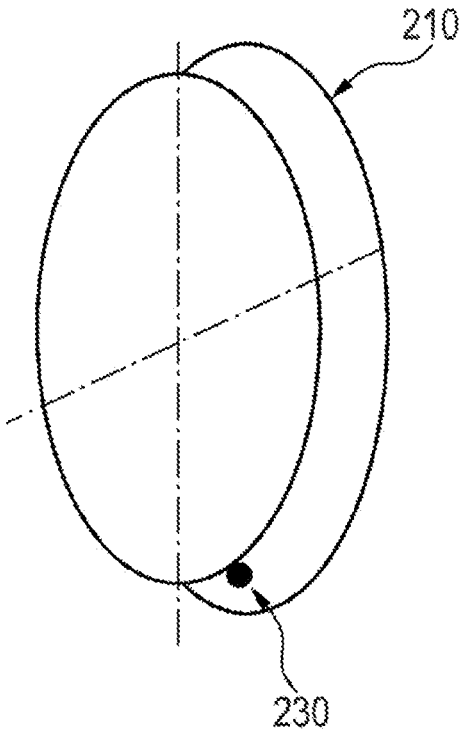

In FIG. 2A, the model is shown for the case where the wheel is turning, while FIG. 2B shows the case where the wheel 210, 420 is locked ("lock up"), with the wheel 210, 420 sliding over the rail 440.

In a model for the case shown in FIG. 2A, Tcircle denotes a temperature, in particular an average temperature, of the tread.

In this example, the mass of the tread 220 is calculated in advance. In this case, use can be made of the Kalker method, for example, in which the radius of the wheel 210 and the width of the surface 220 are determined specifically for the vehicle. Further, the depth of the tread can be calculated on the basis of simulations.

The result is roughly the following representation:

$$\dot{T}_{circle} = \frac{\text{Particio} \cdot P_{in} - \xi_{circle} \cdot (T_{circle} - T_0)}{c \cdot m_{circle}}$$

$$T_{circle} = T_0 + \sum_0^t \dot{T}_{circle} \cdot \Delta t$$

Further, in a model for the case shown in FIG. 2B, it is possible to determine a temperature Tspot of the contact point 230. By way of example, the region of the contact point 230 can be assumed to have an area of approximately 1 cm2 and a depth of 2 mm.

The area can be calculated specifically for the vehicle. The Kalker method, for example, can be used in the process. Further, the depth of the tread can be calculated on the basis of simulations.

The result is roughly the following representation:

$$\dot{T}_{spot} = \frac{\text{Particio} \cdot P_{in} - \xi_{spot} \cdot (T_{spot} - T_0)}{c \cdot m_{spot}}$$

$$T_{spot}(t) = T_{circle} + \sum_0^t \dot{T}_{spot} \cdot \Delta t$$

or more simply:

$$T_{spot}(t) = T_{circle} + \sum_0^t \frac{Particioshort \cdot P_{in} \cdot \Delta t}{c \cdot m_{spot}}$$

FIG. 3 shows an example of how the temperature at a point in the region of the tread of the wheel 210, 420 changes during braking if the wheel 210, 420 turns during a braking process. The increase in the average temperature in the region of the tread is shown as a dashed line 310. Additionally, the temperature peaks shown as a solid line 320 should be considered, with the peaks in each case occurring as the point contacts the rail and absorbs energy, and the energy subsequently being released again and the temperature dropping accordingly (source: P. T. Zwierczyk, "Thermal stress analysis of a railway wheel-rail rolling-sliding contact", Budapest 2015).

The average temperature along the circumference of the tread 230 changes slowly in comparison with the temperature peaks. The average temperature is determined using the simplified model explained above with reference to FIG. 2A. In this example, at least one parameter is determined by fitting using a finite element method (FEM), in particular the dashed line 310 in FIG. 3.

Exemplary values for a model used are given in tabular form below. In particular, physical constants, vehicle-specific constants, and values determined by fitting are shown in a validation using an FEM method and a simulation of the temperature distribution. In particular, the following are listed: The diameter of the wheel (D_wheel), the diameter of the contact region (d_spot) between the wheel and the rail, the thickness of the contact region in the depth of the material of the wheel (h), the area of the contact region (Aspot) or the annular tread (Aring) of the wheel, the volume of the contact region (Vspot) or annular tread (Vring) of the wheel, the density (ro) of the material, the mass of the contact region (mspot) or annular tread (mring) of the wheel, the heat transfer of the material (steel heat transfer, lam), the heat transfer of the tread (lambda ring) or the contact region (lambda spot), and the specific heat (c) of the material.

| Project spec inp | | adj. by validation | Model parameters | | | | | | | steel heat transfer | ksi_ring = lam* | ksi_ spot = | Specific |
|---|---|---|---|---|---|---|---|---|---|---|---|---|---|
| D_wheel mm | d_spot mm | h mm | Aspot mm2 | Aring mm2 | Vspot mm3 | Vring mm3 | ro kg/mm3 | mspot kg | mring kg | "lam" W/mk | Aring/h W/K | lam* Aring/h | heat c J/kgK |
| 840 | 10 | 2 | 78.5 | 26376 | 157 | 52752 | 7.80E−06 | 1.22E−03 | 4.11E−01 | 54 | 712.2 | 2.1 | 460 |
| 840 | 9 | 2 | 63.6 | 27338 | 127 | 47477 | 7.80E−06 | 9.92E−04 | 3.70E−01 | 54 | 640.9 | 1.7 | 460 |
| 840 | 8 | 2 | 50.2 | 21101 | 100 | 42202 | 7.80E−06 | 7.84E−04 | 3.29E−01 | 54 | 569.7 | 1.4 | 460 |
| 960 | 10 | 2 | 78.5 | 30144 | 157 | 60288 | 7.80E−06 | 1.22E−03 | 4.70E−01 | 54 | 813.9 | 2.1 | 460 |
| 960 | 9 | 2 | 63.6 | 27130 | 127 | 54259 | 7.80E−06 | 9.92E−04 | 4.23E−01 | 54 | 732.5 | 1.7 | 460 |
| 960 | 8 | 2 | 50.2 | 24115 | 100 | 48230 | 7.80E−06 | 7.84E−04 | 3.76E−01 | 54 | 651.1 | 1.4 | 460 |

Figure 4:
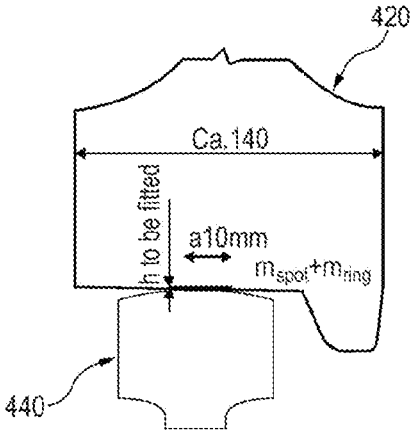
FIG. 4 shows a cross-sectional illustration of a wheel and rail.

The parameters shown are further illustrated in FIG. 4 in an exemplary cross section of a wheel on a rail.

A temperature versus time curve can now be used, for instance on the basis of the data shown in FIG. 3.

In particular, the temperature changes during the braking event, that is to say in particular temperature rises and temperature drops, are taken into account here.

In the process, a check is carried out as to whether, for instance, a certain temperature value has been reached or exceeded. For example, when a certain temperature is reached, a pearlite texture of the wheel material may be changed to an austenite structure. Such a point is marked in FIG. 5 as point "AC3", for example, with the diagram 500 showing characteristic curves of an austenitization of a steel material of the wheel in exemplary fashion.

A further check is carried out as to whether, for instance, the temperature drops so quickly after reaching the value sufficient for austenitization that martensite is formed. A corresponding characteristic curve is shown in FIG. 6, for example. In particular, the graph represents a time-temperature transformation diagram (continuous cooling transformation, CCT).

In the illustrated case, the following material composition is assumed: 0.33% C, 1.12% Mn, 0.30% Si, 0.027% S, 0.018% P, 0.24% Ni, 0.11% Cr, 0.04% Mo, 0.19% Cu, 0.010% Al, grain size 8-9, austenitized at 850° C. (1562° F.) for 1 h.

FIG. 6 shows a CCT diagram 600 for an exemplary steel as the material of the wheel. This diagram relates to the texture of the material as a function of cooling rate.

LIST OF REFERENCE SIGNS

10 Rail vehicle
20 Recording unit
30 Anti-slip apparatus; WP system
40 Evaluation unit
50 Control unit
100 System
210 Wheel
220 Tread
230 Contact region
310 Dashed line
320 Solid line
420 Wheel (cross section)
440 Rail (cross section)
500 Diagram
600 Diagram
S10 Operation
S20 Operation
S30 Operation
S40 Operation
S50 Operation
S60 Operation
S70 Operation

The invention claimed is:

1. A system for monitoring the state of a wheel of a rail vehicle, the system comprising:

a recording unit configured to record at least one operating parameter for the wheel in response to a braking event;

an evaluation unit configured to determine a temperature value for the wheel based on the recorded operating parameter; and a control unit configured to generate and output an output based on the determined temperature value, wherein the temperature value determined for the wheel comprises an average temperature of a tread of the wheel and a temperature distribution along the tread of the wheel and a temperature on a contact surface of the wheel.

2. The system of claim 1, wherein the recording unit is also configured to record a braking parameter.

3. The system of claim 2, wherein the braking parameter is a brake pressure of a brake cylinder and/or a braking force.

4. The system of claim 1, wherein the at least one operating parameter recorded for the wheel comprises a wheel speed, in particular a rotational speed of the wheel, and/or a speed of the rail vehicle.

5. The system of claim 1, wherein the at least one operating parameter recorded for the wheel comprises a time derivative of the wheel speed.

6. The system of claim 5, wherein the operating parameter recorded for the wheel is a time derivative of the wheel speed of the rotational speed of the wheel, and/or of the speed of the rail vehicle.

7. The system of claim 1, further comprising an anti-slip system that records the at least one operating parameter for the wheel.

8. The system of claim 1, wherein the determination of the temperature value for the wheel includes the evaluation unit determining the average temperature of the tread of the wheel using a simplified thermal model and determining peak temperatures using a lookup table.

9. The system of claim 1, wherein the control unit is configured to generate the output depending on at least one temperature threshold value being reached.

10. The system of claim 9, wherein the control unit is configured to determine a probability of occurrence of a damaged region.

11. The system of claim 10, wherein the probability of occurrence of the damaged region is a probability of martensite formation.

12. The system of claim 11, wherein the control unit is further configured to generate the output based on at least one probability threshold value.

13. The system of claim 1, wherein the output comprises a warning message and/or a diagnostic message and/or an error code.

14. The system of claim 13, wherein the control unit is configured to store the output in a diagnostic memory.

15. A method for monitoring the state of a wheel of a rail vehicle, the method comprising:

recording at least one operating parameter for the wheel during a braking event;

determining a temperature value for the wheel based on the recorded operating parameter; and generating and outputting an output based on the determined temperature value, wherein the temperature value determined for the wheel comprises an average temperature of a tread of the wheel and a temperature distribution along the tread of the wheel and/or a temperature on a contact surface of the wheel.

16. The method of claim 15, wherein the recording of the at least one operating parameter for the wheel during the braking event is performed by a recording unit that provides the at least one operating parameter to an evaluation unit that determines the temperature value for the wheel based thereon, wherein the determined temperature value is used by a control unit to generates and output the output based thereon.

17. The method of claim 15, wherein the method further comprises recording at least one of a brake pressure of a brake cylinder and a braking force.

18. The method of claim 15, wherein the at least one operating parameter recorded for the wheel comprises a wheel speed, in particular a rotational speed of the wheel and/or a speed of the rail vehicle, and/or a time derivative of the wheel speed.

19. The method of claim 15, further comprising recording the at least one operating parameter by an anti-slip system that records the at least one operating parameter for the wheel.

20. The method of claim 15, wherein the determination of the temperature value for the wheel includes determining the average temperature of the tread of the wheel using a simplified thermal model and determining peak temperatures using a lookup table.

21. The method of claim 15, wherein the output is generated depending on at least one temperature threshold value being reached.

22. The method of claim 15, wherein the output comprises a warning message and/or a diagnostic message and/or an error code.

* * * * *